United States Patent [19]

Tison

[11] 4,066,016

[45] Jan. 3, 1978

[54] PRINTER WITH INTERMITTANT VARIABLE WEB FEED

[75] Inventor: Eric Tison, Ponthierry, France

[73] Assignee: Ateliers de Constructions Mecaniques Seailles & Tison, Paris, France

[21] Appl. No.: 719,709

[22] Filed: Sept. 2, 1976

Related U.S. Application Data

[63] Continuation of Ser. No. 542,547, Jan. 20, 1975, abandoned.

[30] Foreign Application Priority Data

Jan. 22, 1974 France ..... 74.02027

[51] Int. Cl.[2] ..... B41F 13/04

[52] U.S. Cl. ..... 101/228; 101/216; 101/219; 101/253; 226/32; 226/160

[58] Field of Search ..... 101/277, 212, 216, 219, 101/228, 278, 279, 250, 253, 261; 226/32, 36, 74, 75, 115, 158, 160; 197/133 R, 133 P

[56] References Cited

U.S. PATENT DOCUMENTS

| | | | |
|---|---|---|---|
| 2,639,665 | 5/1953 | Lambert | 101/261 |
| 2,771,837 | 11/1956 | Federwitz | 101/228 |
| 3,548,747 | 12/1970 | D'Amato | 101/228 |
| 3,583,540 | 6/1971 | Bernard | 197/133 R |
| 3,610,147 | 10/1971 | Crissy et al. | 101/253 |
| 3,797,389 | 3/1974 | Wolff | 101/228 |
| 3,808,971 | 5/1974 | Staamann | 101/228 |
| 3,845,850 | 11/1974 | Herr et al. | 197/133 R |

OTHER PUBLICATIONS

Darwin et al., *Bidirectional Printer Carriage,* IBM Technical Disclosure Bulletin, vol. 15, No. 1, p. 157, 6/72.

*Primary Examiner*—Edgar S. Burr
*Assistant Examiner*—William Pieprz

[57] ABSTRACT

The format of sheet material being printed is controlled and may be varied during successive printing cycles of a continuously operating printing machine by means of an assembly, preferably including a step-by-step motor for driving the sheet, which assembly is controlled by pulses and moves the sheet during a period within which no printing takes place.

8 Claims, 8 Drawing Figures

PRINTER WITH INTERMITTANT VARIABLE WEB FEED

Figure 1:
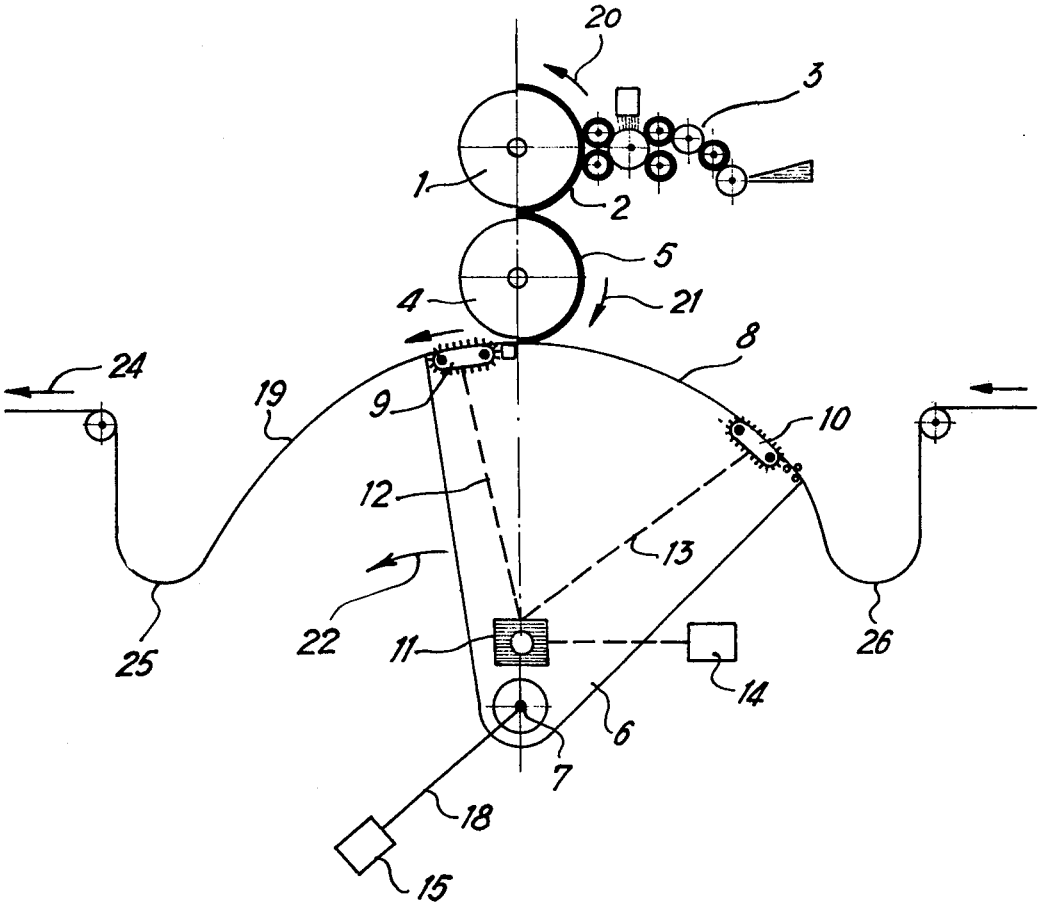

This is a continuation, of application Ser. No. 542,547, filed Jan. 20, 1975, now abandoned.

The present invention relates to method and devices for causing the format of a material in sheet form which is to be printed to vary during operation.

The format of a material to be printed is the term used for that surface of the material which is reserved to receive the imprint, said imprint having its own format which depends on the printing plate and which is, at maximum, equal to the format of the material.

When said material is in the form of a sheet, the format of the material depends on the length of the sheet which is caused to pass through the printing unit at each printing cycle.

In the devices used up to the present time for the continuous printing of a sheet it has not been possible to modify the length caused to pass through the printing unit during operation and it has been necessary to stop the machine and to change certain parts of the driving mechanism in order to modify the length of material caused to pass in front of the printing element during a printing cycle.

This inability to modify the form of the sheet to be printed in a continuously operating printing machine during operation constitutes an inconvenience in many cases.

This is the case, for example, when printing a cheque book. The make-up of a cheque book requires the combination of an assembly of leaves which carry differing imprints such as cheque forms, forms for renewal of the cheque book, paying-in slips, etc.

The fundamental problem posed by the continuous production of the various imprints of a cheque book, in the required order, on a sheet of paper passing through a series of printing units is that of the necessity to be able to arrange the blanks in the series of imprints by one printing unit in such a way that said blanks can receive other imprints subsequently.

A solution to this fundamental problem has already been proposed, such as that, for example, published in French Pat. Nos. 1,589,381 and in British Pat. Nos. 1,225,311 and 1,224,617 and U.S. Pat. No. 3,541,953.

This known solution consists, in principle, of producing a blank by retracting a printing element, the length of paper passing through during each printing cycle being constant.

The present invention has as its object another solution which consists, in principle, of producing a blank by modifying the length of paper passing through during a printing cycle, the length of paper passing through during a cycle which is to produce both an imprint and a blank being greater than the length of paper passing through during a cycle which is to produce an imprint only, the difference in length corresponding to the length of the blank required.

This solution is much simpler because it does not require the use of retractable printing elements. It is also much more flexible in operation because by its use it is possible to modify the number of blanks at will, while in the known solution of retraction this number is determined by the possibilities for retraction of the printing elements, which are fixed by the construction and which cannot be modified.

In order to be able to modify the length of the paper, or of other material in sheet form, passing through a printing unit without interrupting the operation of the unit it is recommended, according to the invention, to control the operation of the device for driving the sheet by means of pulses during a part of the printing cycle in the course of which there will be no imprint, the number of pulses determining the length of sheet drawn through.

It is thus very easy to modify said length by simply changing the number of pulses, each length which is caused to pass through determining one format of the sheet.

The sheet to be printed passes through printing units, each of which includes, in principle, a platen over which the sheet passes and which acts in conjunction with the printing element of the unit to produce the necessary pressure for printing.

According to the invention, the method according to the invention is put into operation by employing a pivoting platen which is caused to pivot with an alternating movement including one travel during which the imprint is produced and a return travel in the opposite direction during which the sheet is caused to pass through by the distance determined by the number of pulses.

A discontinuous driving of the sheet is thus produced.

Preferably, a step-by-step driving motor, controlled by pulses, and, preferably, mounted on the platen, is used to produce movement of the sheet over the platen.

The "step-by-step" motor is a motor, well known in itself, the significant characteristic of which is that the shaft of the motor takes up exactly the same angular position after a whole number of cycles of rotation, by contrast with other motors which exhibit random angular displacements.

Instead of using a step-by-step motor, it is possible to use systems which include an ordinary motor with associated means acting on the transmission between the shaft of said motor and a driven shaft in such a way that a perfectly reproducible rotation of the driven shaft is ensured; such systems are also well known, for example in computer printers, but they have the inconvenience of considerable complexity in comparison with the simple step-by-step motor.

The means of driving the sheet by the motor used are any adequate means. It is preferable to employ traction by means of points driven by the motor and engaging in perforations in the sheet.

Such a method of driving the sheet is well known in itself.

Preferably, according to the invention, a curved platen is used and the position in space of the zone of contact between the sheet and the platen is kept fixed during pivoting of the platen and during movement of the sheet.

In a preferred embodiment, the zone of contact is given an extension which corresponds substantially to that of half the surface of a cylinder, the running surface of the platen being greater than the zone of contact.

For example, said running surface is given an extension which corresponds substantially to that of three quarters of the surface of a cylinder.

The following advantages can be achieved in this way:

the sheet does not undergo any shock during the movements of the platen;

the force of traction of the sheet is produced during the return travel of the platen in the opposite direction to the movement of the sheet, which relieves the strain of the force of traction on the sheet to a certain extent. In the extreme case when the length of sheet caused to pass through is equal to the travel of the platen, the sheet will always be in the same position relative to the horizontal line passing through the axle of the platen, before and after the return travel of the platen.

There is compensation of the two movements:

1. the return travel of the platen,
2. the forward movement of the sheet.

Use is made of the inertia of the sheet, the two acceleration curves, that of the platen and that of forward movement of the sheet, are compensated in order to reduce the force on the sheet which it is necessary for the traction points to exert.

The printing units are normally units with printing drums, said drum carrying one or several printing elements on part of its surface.

According to the invention, the same driving motor is preferably used to activate both the means of printing and the printing counterpressure platen and the movement of said motor is transmitted, on the one hand, to the means of printing and, on the other hand, to the platen through a connecting gear.

This makes it possible to interrupt the operation of the printing machine easily without interrupting the passage of the paper which is controlled separately, for example, in order to reserve zones on the band of paper which are intended to be printed by another printing machine.

The control of the connecting gear may be programmed according to the distribution of the zones which are to be reserved.

Figure 2:
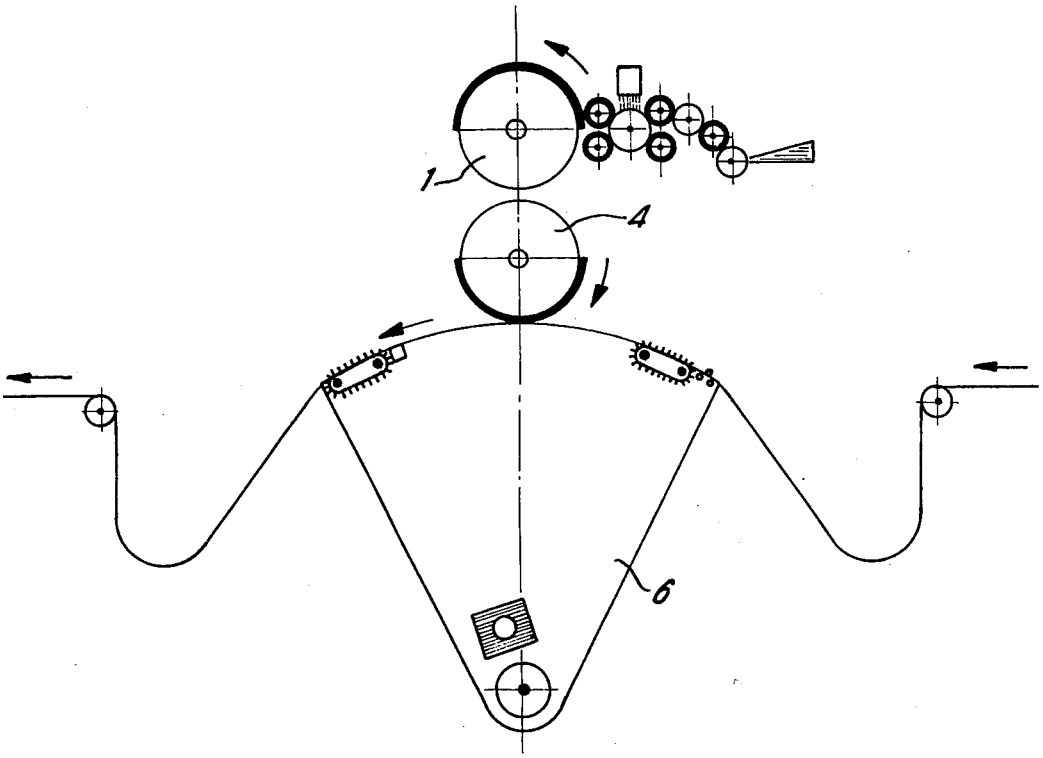
Figure 3:
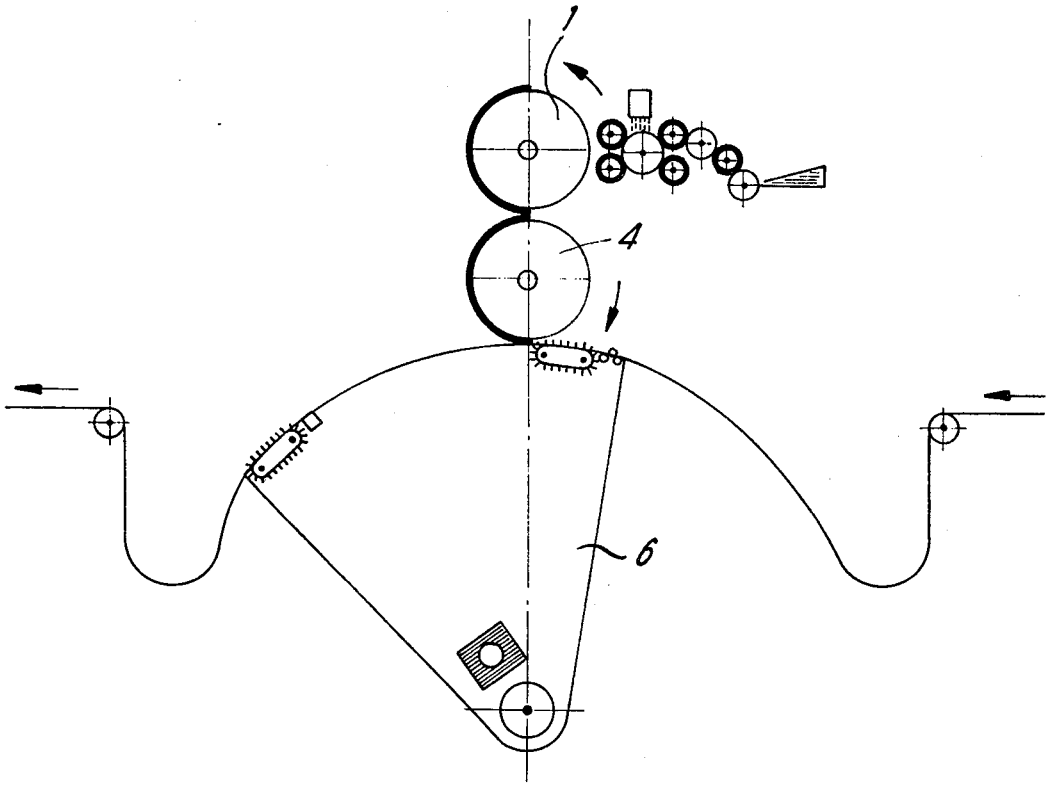
Figure 4:
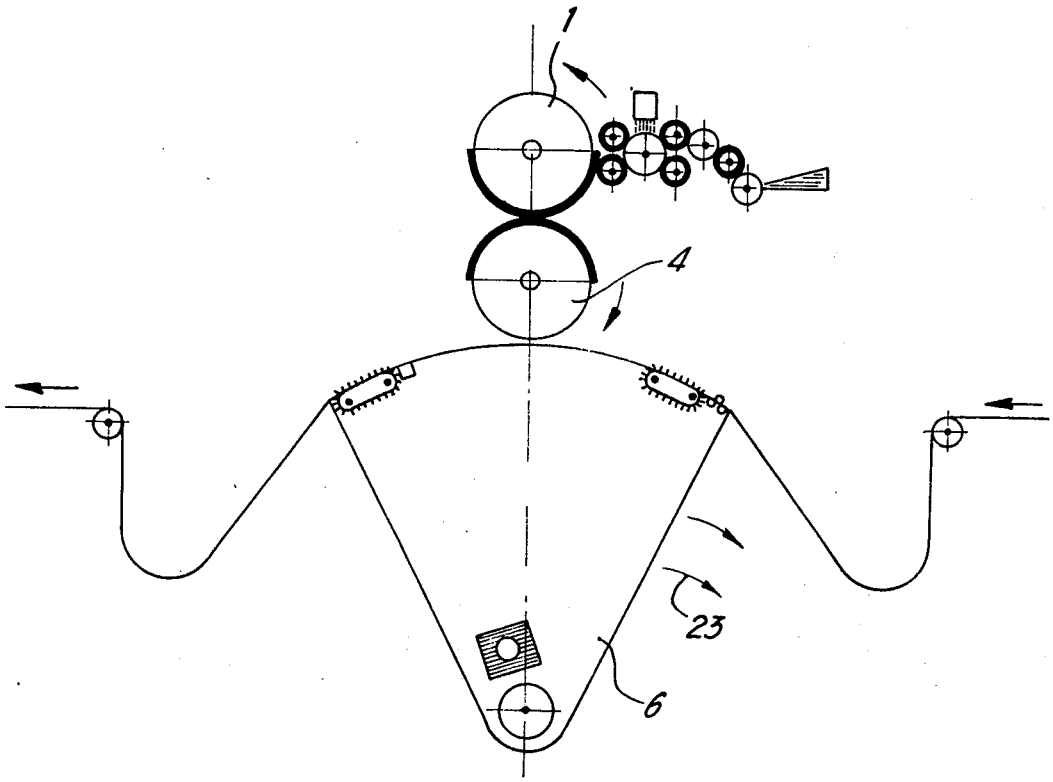
Figure 5:
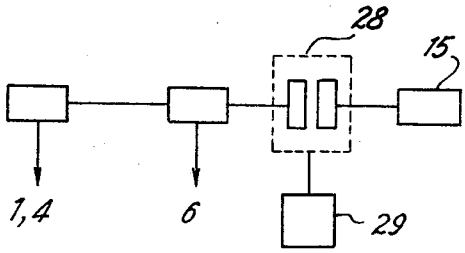
Figure 8:
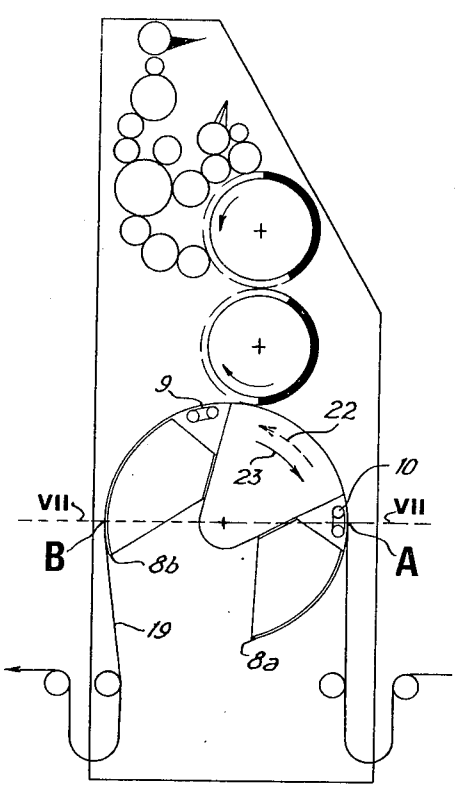
Figure 7:
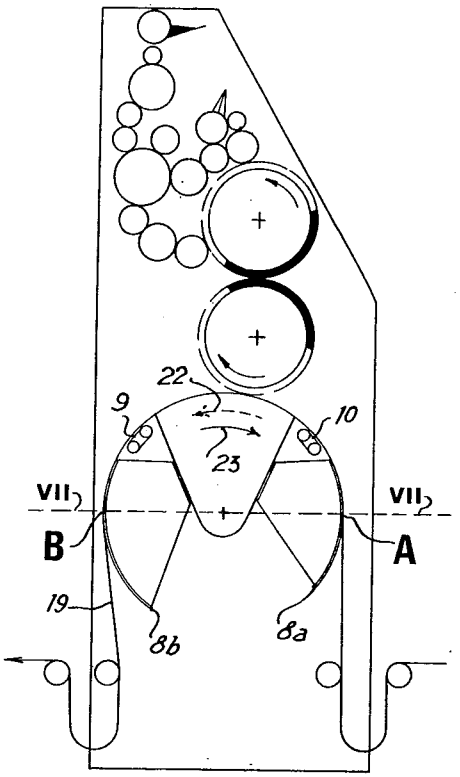
Figure 6:
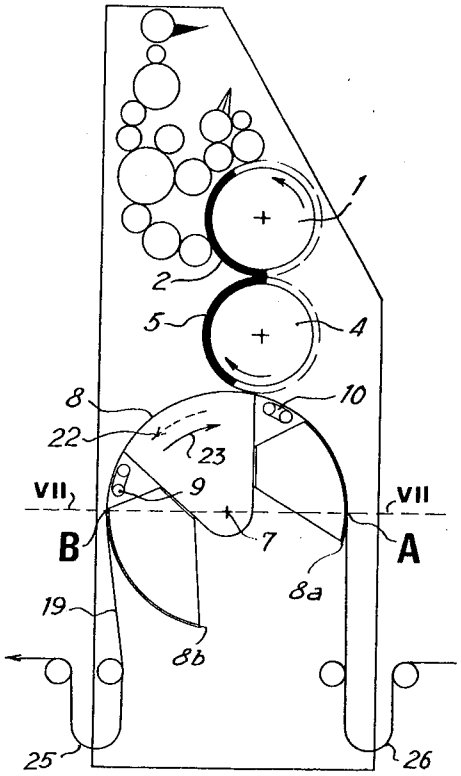

Printing devices embodying the invention will now be described with reference to the accompanying drawings, in which FIG. 1 is a diagram of a printing device embodying the present invention, at the start of the forward travel of the platen of the device, FIG. 2 illustrates the device of FIG. 1 in the middle of the forward travel of the platen, FIG. 3 illustrates the device of FIG. 1 at the end of the forward travel of the platen, FIG. 4 illustrates the device of FIG. 1 at the middle of the return travel of the platen. platen, FIG. 5 is a diagram of the means of driving the printing device and the platen, and FIGS. 6 to 8 are vertical sections through a second embodiment, in which the platen is seen at the completion of printing in its forward travel in the direction of movement of the paper (FIG. 6), in an intermediate position during the return travel (FIG. 7), and in the extreme return position which corresponds to the beginning of printing (FIG. 8).

The printing device illustrated includes a printing assembly and a counterpressure platen.

The printing assembly, which may be of any known printing assembly, is in this example a rotary assembly (dry or wet offset) which has been reduced, in order to simplify the description, to its characteristic elements, comprising a first cylinder 1 carrying a printing plate 2 with which is associated an inking and damping assembly 3, and a cylinder 4 which carries a blanket 5 for transfer of the image.

The counterpressure printing platen which forms that part of the device with which the invention is concerned, is a platen 6 mounted to pivot in an alternating manner about an axle 7 and having a running surface 8 which has the form of a segment of a cylinder with its axis on the axle 7.

The platen carries chains or other traction means with teeth, for example, two traction means 9 and 10 arranged, respectively, close to one or other of the extremities of the running surface 8 in the direction required by the movement of the material to be printed, the rotation of the teeth taking place about axes parallel to the axle 7.

The rotation of these traction means is ensured by a step-by-step motor 11 mounted on the platen, connected to the traction means by suitable transmissions 12 and 13, and controlled by pulses from a pulse generator 14, which permits a very precise control.

The traction means with teeth, the step-by-step motor, the transmissions and the pulse generator are well known means which it is unnecessary to describe in detail.

The platen 6 is propelled in an alternating backward and forward movement about the axle 7 by means of a driving motor 15 fitted with a suitable transmission 18, including, for example, a cam.

It is obviously unnecessary to describe such means of driving in detail.

The material in sheet form to be printed, for example a band of paper 19, has perforations for lateral driving along the band ("carol" perforations). The driving means with teeth are mounted on the platen in such a way as to engage with said perforations.

This device is put into operation in the following manner:

The cylinders 1 and 4 are given (in a manner well known in itself) a rotational movement of constant velocity in opposite directions of rotation, indicated in the Figures by the arrows 20 and 21.

The platen 6 is activated with an alternating movement which includes a forward travel (according to the arrow 22) with a constant velocity and a return travel (according to the arrow 23).

The paper is driven by the teeth in the forward direction (in the direction of the arrow 24) only during the return travel of the platen. Thus the paper is fixed relative to the platen during its forward travel and, in order to ensure the stability of the paper and to avoid its accidental displacement, it is possible to fit the platen with a ramp with evacuation of air in the neighbourhood of the driving device 9 so as to keep the paper in contact with the platen at its head by aspiration.

During a printing cycle, that is a complete rotation of the cylinders 1 and 4, the plate 2 and the blanket 5 are in mutual contact during one fraction of the cycle (the transfer phase) to ensure the transfer of the image (part of the cylinder) from the plate 2 to the blanket 5 and it is assumed, in the case illustrated, that this contact takes place during half the cycle. During the transfer phase, the platen 6 carries out its return travel and the blanket 5 has no contact with the paper on the platen.

During the other fraction of the cycle (the printing phase) the platen 6 carries out its forward movement and the blanket 5 is in contact with the paper 19 on the platen 6 in order to transfer to the paper 19 the image received from the plate 2. During this printing phase, the cylinders 1 and 4 have no mutual contact because of the cavities with which they are provided.

The start, the middle, and the end of the printing phase are represented in FIGS. 1, 2 and 3, respectively. The middle of the transfer phase is represented in FIG. 4.

Upstream and downstream of the device, free loops 25, 26 in the paper 19 allow the movement of the platen 6 to be carried out without damage to the band of paper 19.

In order to ensure the forward movement of the paper 19 between two successive printing phases, the operation of the driving devices is so controlled as to take place during the return travel of the platen, the number of pulses for the control of the step-by-step motor being chosen as a function of the distance of forward movement which it is desired to obtain, that is as a function of the format which it is desired to obtain.

It will be understood that such a device makes modification of the format of the paper very easy since it is sufficient to vary the number of pulses.

For example, if 24 pulses correspond to a format of one inch, 4 pulses will correspond to a format of 1/6 of an inch and 3 pulses will correspond to a format of ⅛ of an inch. As a result of this progression, it is possible to approximate the formats in millimeters (1 pulse = 1/24 of an inch = 1.0 mm) with very small errors according to the nominal dimension required. The choice of the formats can be easily controlled by means of a commutator means, a co-ordinate diagram, a programme card, etc.

Maladjustment of the paper 19 on the platen 6 during the printing phase is prevented by the fact that the paper is held by the traction devices with teeth and also, where necessary, by an auxiliary holding device such as, for example, the aspiration device described above.

The simplicity of integral control of the format of the paper according to a programme is particularly useful for continuous offset printing (wet or dry). In the example described, with step-by-step forward movement of the paper, it is possible to change the format of the paper between two successive printings by means of a simple programme without stopping the machine, the format of the imprint itself remaining as defined by the plate mounted on the printing machine.

FIG. 5 is a schematic showing of a particular mode of control of the operation of the installation.

The motor 15, which activates the platen 6, also activates the cylinders 1 and 4 and the transmission between the motor and the platen and between said motor and the cylinders includes a connecting gear 28, controlled by a programmed control device 29.

The programme defines periods of disengagement during which the paper can pass through without receiving an imprint at this position.

The fact that the motor and the connecting gear are common to the printing elements and to the platen ensures that the control of co-ordination between the printing elements and the platen is maintained.

FIGS. 6 to 8 relate to an embodiment in which the platen has the form of a segment of a cylinder corresponding substantially to three quarters of the cylinder. A larger extension is possible but does not appear to be useful in the case illustrated.

Contact between the paper 19 and the platen is effected over a zone AB of the platen, the cross-section of which corresponds substantially to a semi-circle, and the position of this zone is fixed in such a way that the band of paper remains substantially vertical both throughout the length immediately preceding the platen and throughout the length immediately following the platen, during movement of the platen and during movement of the paper.

Upstream and downstream of these two lengths, the band of paper forms loops 26 and 25 in a manner well known in itself.

The platen performs an alternating pivoting movement about an axle 7, this movement including a rotation in the direction of the arrows 22, during which imprinting of the paper takes place by means of the printing drum 4 which carries a printing element 5, and a return rotation in the direction of the arrow 23 during which the traction devices with teeth 9 and 10, mounted on the platen, are activated in such a way as to bring about the desired forward movement of the paper on the platen, according to the format desired.

In FIG. 6, the platen is in the position of the end of printing, at the end of its travel in the direction of the arrow 22. In FIG. 8 the platen is in the position of the beginning of printing, at the end of its travel in the direction of the arrow 23. In FIG. 7 the platen is in an intermediate position during the return travel in the direction of the arrow 23.

During pivoting of the platen, the ends of the running surface of the platen do not rise above the horizontal VII—VII which passes through the axle of pivoting of the platen.

The surface of the platen which forms the total running surface is, in fact, that which is limited on the right by the line of the platen situated opposite to A (in FIG. 6) and, on the left, by the line of the platen which is situated opposite to B (in FIG. 8). In the case illustrated the extremities of this surface differ little, respectively, from the extremities 8*a* and 8*b* of the platen, and the extent of the running surface is substantially equivalent to three quarters of a cylinder.

Changing the length of the paper during operation and disengaging a printing head to allow one or several cycles to pass without stopping the movement of the paper are two distinct options which may be used independently of each other, or which may be used together to give further programmable combinations.

Finally, it is understood that when using a plurality of printing devices there is an engagement mechanism for each printing element. Each printing element is provided with a counting system arranged to operate the engagement mechanism at a desired moment to cause the printing unit to print or to stop printing. This device enables the programming of a printing unit on the number of cycles desired by the user.

What I claim is:

1. A printing device for printing spaced indicia on a moving band of material including means for defining printing and non-printing phases of machine operation comprising at least one rotatable printing element for printing indicia on the band, at least one counter pressure printing platen pivotally mounted about an axis for cooperating with said at least one printing element during the printing phase and having a curved surface for supporting the band, motor means for reciprocatingly pivoting said pivotally mounted platen, traction means mounted on said platen for engaging the band to move said band intermittently over the surface of said platen during the non-printing phase, a pulse generator for generating varying numbers of pulses in accordance with a program, a step by step motor operable by the pulses of said generator for actuating said traction means for moving varying lengths of the band over the surface of the platen during the non-printing phase in accordance with the number of pulses generated by the generator in accordance with the program.

2. A printing device as claimed in claim 1 wherein said step by step motor is mounted on said platen.

3. A printing device as claimed in claim 1 wherein said traction means is provided with teeth means disposed forwardly and rearwardly of the surface of said platen for engaging said band.

4. A printing device as claimed in claim 1 wherein said platen has the form of a segment of a cylinder.

5. A printing device as claimed in claim 4, wherein the surface of said platen is substantially semi-cylindrical and the band is supported substantially entirely along the semi-cylindrical surface.

6. A printing device as claimed in claim 4 wherein the surface of said platen is substantially three quarters of the surface of a cylinder.

7. A printing device as claimed in claim 1 and further comprising a rotatable cylinder, said printing element being mounted on said rotatable cylinder.

8. A printing device as claimed in claim 7 wherein said motor means rotates said rotatable cylinder on which is mounted said printing element.

* * * * *